United States Patent [19]

Nikolayuk et al.

[11] Patent Number: 4,590,480

[45] Date of Patent: May 20, 1986

[54] BROADCAST ANTENNA WHICH RADIATES HORIZONTAL POLARIZATION TOWARDS DISTANT LOCATIONS AND CIRCULAR POLARIZATION TOWARDS NEARBY LOCATIONS

[75] Inventors: Nicholas Nikolayuk, Gibbsboro; Thomas V. Sikina, Jr., Moorestown, both of N.J.

[73] Assignee: RCA Corporation, Princeton, N.J.

[21] Appl. No.: 646,111

[22] Filed: Aug. 31, 1984

[51] Int. Cl.[4] ..... H01Q 13/10

[52] U.S. Cl. ..... 343/771; 343/725

[58] Field of Search ..... 343/767, 770, 771, 725

[56] References Cited

U.S. PATENT DOCUMENTS

| | | | |
|---|---|---|---|
| 2,946,055 | 7/1960 | Faflick | 343/727 |
| 2,972,147 | 2/1961 | Wilkinson | 343/767 |
| 2,981,947 | 4/1961 | Bazan | 343/767 |
| 3,340,534 | 9/1967 | Fee | 343/728 |
| 4,021,815 | 5/1972 | Bogner | 343/727 |
| 4,129,871 | 12/1978 | Johns | 343/727 |
| 4,297,706 | 10/1981 | Nikolayuk | 343/771 |

OTHER PUBLICATIONS

Antennas by Kraus, published by McGraw-Hill Book Co., 1950, pp. 356-361.

Antenna Engineering Handbook edited by Jasik, published by McGraw-Hill, 1970, p. 8-2.

*Primary Examiner*—Eli Lieberman

*Attorney, Agent, or Firm*—Joseph S. Tripoli; Robert L. Troike; William H. Meise

[57] ABSTRACT

A television broadcast antenna includes a high-gain pylon consisting of a vertical array of slots in a conductive cylinder for radiating with high gain towards distant locations. An auxiliary low-gain vertically-polarized portion of the antenna has its phase center coincident with or near the phase center of the pylon for radiating a vertically polarized signal component. This position of the auxiliary portion reduces wind load and feed-line length by comparison with a location above the pylon. In a particularly advantageous embodiment of the invention, the horizontally-polarized radiation pattern of the pylon in the region within a few degrees below the main beam, which is the region directed towards local television viewers, has a low but relatively constant amplitude and phase. The auxiliary portion of the antenna produces a vertically-polarized radiation component in this region which has about the same amplitude as the horizontal component and which is approximately in phase quadrature with the horizontally-polarized component, and which therefore provides local (often urban) viewers with circular polarization for reducing ghosting. Distant viewers receive the benefits of high gain and high radiated power in the horizontally-polarized component.

15 Claims, 29 Drawing Figures

Fig. 3c
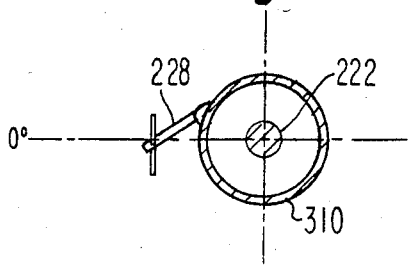
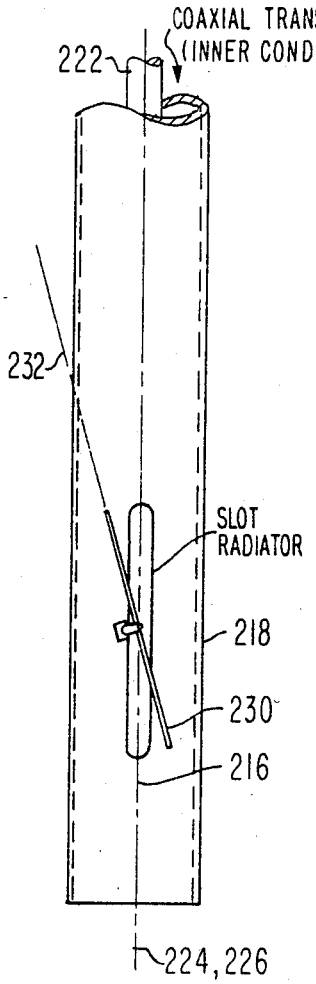
Fig. 3a
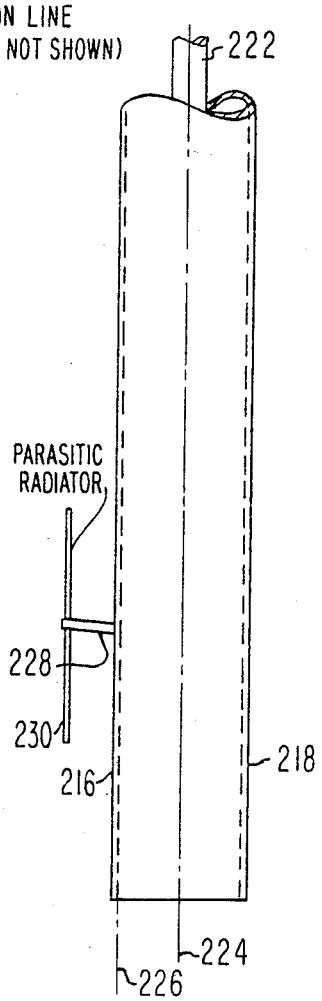
Fig. 3b

AZIMUTH PLANE

AXIAL-RATIO PATTERN

AZIMUTH PLANE

SOLID LINE-HORIZONTAL POLARIZATION
DASHED LINE-VERTICAL POLARIZATION

ELEVATION PLANE

AXIAL-RATIO PATTERN

ELEVATION PLANE

Fig. 6a
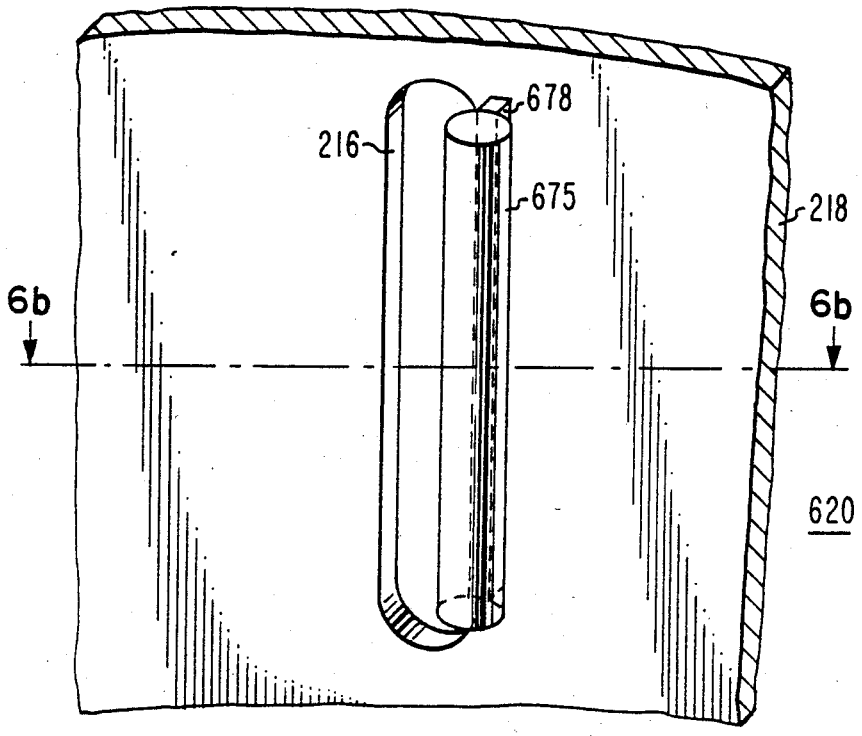
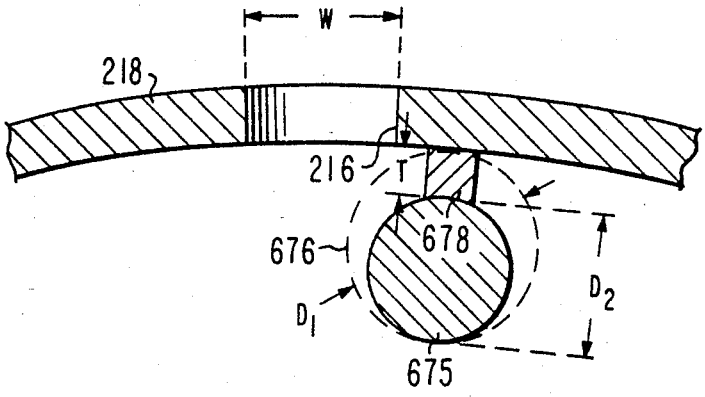
Fig. 6b

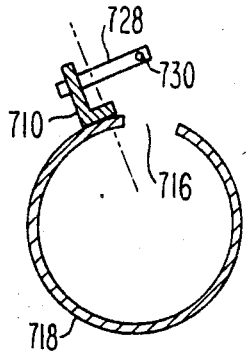
Fig. 7b
Fig. 7a
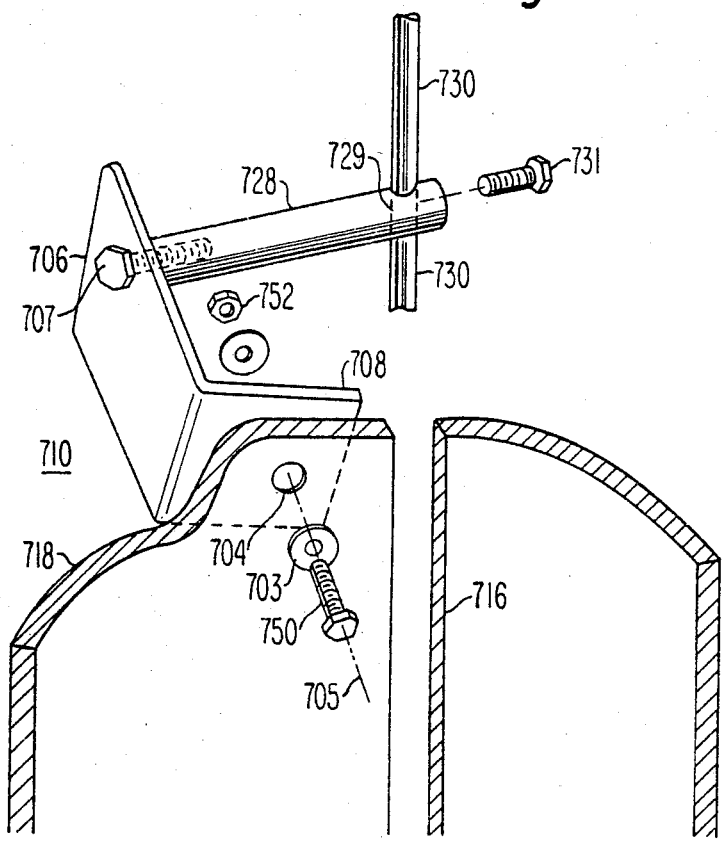

SLOT AND COUPLER DATA FOR CHANNEL 31
(573.25 MHz PIX CARRIER, $\lambda$ = 20.6)

ALL DIMENSIONS IN INCHES.

| LAYER NO. | CENTER LINE SLOT SEPARATION | SLOT LENGTH | COUPLER DIAMETER | BAR THICKNESS |
|---|---|---|---|---|
| 1 (BOTTOM) | - | 12.250 | 0.625 | - |
| 2 | 20.2500 | 13.000 | 0.750 | - |
| 3 | 20.4688 | 13.875 | 1.000 | - |
| 4 | 20.4688 | 13.875 | 1.250 | - |
| 5 | 20.4688 | 13.875 | 1.375 | - |
| 6 | 20.4688 | 13.000 | 1.375 | - |
| 7 | 20.1562 | 12.500 | 1.375 | - |
| 8 | 20.4688 | 12.500 | 1.375 | 0.125 |
| 9 | 20.4688 | 12.000 | 1.375 | 0.125 |
| 10 | 20.4688 | 11.750 | 1.375 | 0.125 |
| 11 | 20.4688 | 11.750 | 1.375 | 0.125 |
| 12 | 20.1562 | 11.437 | 1.375 | 0.187 |
| 13 | 20.4062 | 11.375 | 1.375 | 0.125 |
| 14 | 20.4062 | 11.375 | 1.375 | 0.125 |
| 15 | 20.3937 | 11.125 | 1.375 | 0.312 |
| 16 | 19.7500 | 10.750 | 1.375 | 0.312 |
| 17 | 20.5000 | 10.875 | 1.375 | 0.375 |
| 18 | 19.7188 | 10.937 | 1.375 | 0.187 |
| 19 | 20.1562 | 11.125 | 1.375 | - |
| 20 | 20.2500 | 11.187 | 1.375 | 0.062 |
| 21 | 20.2500 | 11.125 | 1.375 | - |
| 22 | 19.9375 | 11.125 | 1.312 | - |
| 23 | 20.2812 | 11.125 | 1.281 | - |
| 24 | 20.2812 | 11.125 | 1.250 | - |
| 25 | 20.3125 | 11.187 | 1.187 | - |
| 26 | 20.3437 | 11.250 | 1.125 | - |
| 27 | 20.0625 | 11.250 | 1.062 | - |
| 28 | 20.3750 | 11.250 | 1.000 | - |
| 29 | 20.4062 | 11.375 | 0.875 | - |
| 30 | 20.4375 | 11.500 | 0.812 | - |
| 31 | 20.4687 | 11.750 | 0.687 | - |
| 32 (TOP) | 20.2500 | 12.250 | 0.625 | - |

SLOT WIDTH 1.5 INCH

*Fig. 8*

*Fig. 10a*

DEPRESSION

| ANGLE | FIELD | ANGLE | FIELD | ANGLE | FIELD | ANGLE | FIELD | ANGLE | FIELD |
|---|---|---|---|---|---|---|---|---|---|
| -3.00 | .0658 | -2.75 | .0867 | -2.50 | .0938 | -2.25 | .0815 | -2.00 | .0453 |
| -1.75 | .0169 | -1.50 | .1048 | -1.25 | .2154 | -1.00 | .3429 | -.75 | .4795 |
| -.50 | .6160 | -.25 | .7429 | .00 | .8511 | .25 | .9331 | .50 | .9836 |
| .75 | 1.0000 | 1.00 | .9828 | 1.25 | .9351 | 1.50 | .8624 | 1.75 | .7717 |
| 2.00 | .6711 | 2.25 | .5681 | 2.50 | .4698 | 2.75 | .3817 | 3.00 | .3074 |
| 3.25 | .2487 | 3.50 | .2055 | 3.75 | .1762 | 4.00 | .1584 | 4.25 | .1488 |
| 4.50 | .1444 | 4.75 | .1424 | 5.00 | .1409 | 5.25 | .1385 | 5.50 | .1347 |
| 5.75 | .1297 | 6.00 | .1241 | 6.25 | .1186 | 6.50 | .1138 | 6.75 | .1104 |
| 7.00 | .1084 | 7.25 | .1077 | 7.50 | .1080 | 7.75 | .1087 | 8.00 | .1093 |
| 8.25 | .1095 | 8.50 | .1089 | 8.75 | .1077 | 9.00 | .1060 | 9.25 | .1041 |
| 9.50 | .1026 | 9.75 | .1017 | 10.00 | .1017 | 10.25 | .1025 | 10.50 | .1041 |
| 10.75 | .1059 | 11.00 | .1076 | | | | | | |

*Fig. 10b*

DEPRESSION

| ANGLE | FIELD | ANGLE | FIELD | ANGLE | FIELD | ANGLE | FIELD | ANGLE | FIELD |
|---|---|---|---|---|---|---|---|---|---|
| -3.00 | 180.00 | -2.75 | -180.00 | -2.50 | -180.00 | -2.25 | -180.00 | -2.00 | 180.00 |
| -1.75 | -.00 | -1.50 | -.00 | -1.25 | -.00 | -1.00 | -.00 | -.75 | -.00 |
| -.50 | -.00 | -.25 | -.00 | .00 | -.00 | .25 | -.00 | .50 | -.00 |
| .75 | .00 | 1.00 | .00 | 1.25 | .00 | 1.50 | .00 | 1.75 | .00 |
| 2.00 | -.00 | 2.25 | .00 | 2.50 | .00 | 2.75 | .00 | 3.00 | -.00 |
| 3.25 | .00 | 3.50 | .00 | 3.75 | .00 | 4.00 | -.00 | 4.25 | -.00 |
| 4.50 | -.00 | 4.75 | .00 | 5.00 | .00 | 5.25 | -.00 | 5.50 | .00 |
| 5.75 | -.00 | 6.00 | .00 | 6.25 | .00 | 6.50 | -.00 | 6.75 | -.00 |
| 7.00 | -.00 | 7.25 | .00 | 7.50 | .00 | 7.75 | -.00 | 8.00 | .00 |
| 8.25 | .00 | 8.50 | -.00 | 8.75 | .00 | 9.00 | -.00 | 9.25 | -.00 |
| 9.50 | -.00 | 9.75 | -.00 | 10.00 | .00 | 10.25 | .00 | 10.50 | -.00 |
| 10.75 | .00 | 11.00 | .00 | | | | | | |

Fig. 10c

ILLUMINATION

| POSITION | AMPLITUDE | AMPL (DB) | PHASE |
|---|---|---|---|
| -1.5000 | 1.0000 | 0.0000 | 0.0000 |
| -.5000 | .8748 | -1.1618 | 25.4257 |
| .5000 | .8067 | -1.8655 | 50.8514 |
| 1.5000 | .7428 | -2.5824 | 76.2771 |

Fig. 10d

DEPRESSION

| ANGLE | FIELD | ANGLE | FIELD | ANGLE | FIELD | ANGLE | FIELD | ANGLE | FIELD |
|---|---|---|---|---|---|---|---|---|---|
| -3.00 | .6637 | -2.75 | .6851 | -2.50 | .7060 | -2.25 | .7264 | -2.00 | .7462 |
| -1.75 | .7656 | -1.50 | .7843 | -1.25 | .8025 | -1.00 | .8199 | -.75 | .8368 |
| -.50 | .8529 | -.25 | .8683 | .00 | .8829 | .25 | .8968 | .50 | .9099 |
| .75 | .9221 | 1.00 | .9336 | 1.25 | .9441 | 1.50 | .9538 | 1.75 | .9626 |
| 2.00 | .9705 | 2.25 | .9775 | 2.50 | .9835 | 2.75 | .9886 | 3.00 | .9928 |
| 3.25 | .9960 | 3.50 | .9983 | 3.75 | .9996 | 4.00 | 1.0000 | 4.25 | .9994 |
| 4.50 | .9978 | 4.75 | .9953 | 5.00 | .9919 | 5.25 | .9875 | 5.50 | .9822 |
| 5.75 | .9760 | 6.00 | .9688 | 6.25 | .9608 | 6.50 | .9519 | 6.75 | .9421 |
| 7.00 | .9315 | 7.25 | .9201 | 7.50 | .9078 | 7.75 | .8948 | 8.00 | .8810 |
| 8.25 | .8665 | 8.50 | .8512 | 8.75 | .8353 | 9.00 | .8187 | 9.25 | .8015 |
| 9.50 | .7836 | 9.75 | .7652 | 10.00 | .7463 | 10.25 | .7269 | 10.50 | .7069 |
| 10.75 | .6866 | 11.00 | .6658 | | | | | | |

Fig. 10e

DEPRESSION

| ANGLE | PHASE RELATIVE TO HORIZ. | ANGLE | PHASE RELATIVE TO HORIZ. | ANGLE | PHASE RELATIVE TO HORIZ. | ANGLE | PHASE RELATIVE TO HORIZ. | ANGLE | PHASE RELATIVE TO HORIZ. |
|---|---|---|---|---|---|---|---|---|---|
| -3.00 | 31.53 | -2.75 | 31.86 | -2.50 | 32.19 | -2.25 | 32.49 | -2.00 | 32.79 |
| -1.75 | 33.07 | -1.50 | 33.35 | -1.25 | 33.61 | -1.00 | 33.87 | -.75 | 34.12 |
| -.50 | 34.37 | -.25 | 34.60 | .00 | 34.83 | .25 | 35.06 | .50 | 35.28 |
| .75 | 35.50 | 1.00 | 35.71 | 1.25 | 35.93 | 1.50 | 36.13 | 1.75 | 36.34 |
| 2.00 | 36.54 | 2.25 | 36.74 | 2.50 | 36.94 | 2.75 | 37.13 | 3.00 | 37.33 |
| 3.25 | 37.52 | 3.50 | 37.72 | 3.75 | 37.91 | 4.00 | 38.10 | 4.25 | 38.29 |
| 4.50 | 38.48 | 4.75 | 38.68 | 5.00 | 38.87 | 5.25 | 39.06 | 5.50 | 39.26 |
| 5.75 | 39.46 | 6.00 | 39.65 | 6.25 | 39.85 | 6.50 | 40.06 | 6.75 | 40.26 |
| 7.00 | 40.47 | 7.25 | 40.68 | 7.50 | 40.89 | 7.75 | 41.11 | 8.00 | 41.33 |
| 8.25 | 41.56 | 8.50 | 41.79 | 8.75 | 42.03 | 9.00 | 42.27 | 9.25 | 42.52 |
| 9.50 | 42.78 | 9.75 | 43.05 | 10.00 | 43.32 | 10.25 | 43.61 | 10.50 | 43.90 |
| 10.75 | 44.21 | 11.00 | 44.53 | | | | | | |

ADD 51.92° TO EACH PHASE ANGLE

WAVE POLARIZATION CHART

AXIAL RATIO = AR = 20 log $\frac{0\beta}{0\beta}$

POLARIZATION RATIO = P = 20 log Ey/Ex $\beta$ = TILT ANGLE $\phi = \phi y - \phi x$

BROADCAST ANTENNA WHICH RADIATES HORIZONTAL POLARIZATION TOWARDS DISTANT LOCATIONS AND CIRCULAR POLARIZATION TOWARDS NEARBY LOCATIONS

This invention relates to a broadcast antenna particularly suited for terrestrial UHF television broadcast service, which radiates a horizontally-polarized field towards distant locations (towards the horizon) and a circular polarized field towards nearby locations.

The broadcasting of television signals is a major business. Terrestrial television broadcasting involves the transmission of high-power VHF (54–216 MHz) or UHF (470–830 MHz) television signals from an antenna location to the public. Broadcasters generally try to use the maximum allowable power in order to reach the maximum number of viewers. Since the income of a television broadcaster depends on the number of viewers which can be reached by his television signal, broadcasters often select antenna locations which are especially advantageous for disseminating their signals. Once the maximum amount of power has been reached, it is desirable to raise the antenna to the highest possible position to increase the line-of-sight distance to distant locations. For this purpose, the antenna is often mounted on a tower or a hill to increase the line-of-sight distance to remote locations. As the line-of-sight distance increases, the transmission path length to the viewer's location also increases, thereby increasing the path loss from the antenna site to the viewer's location, thereby making the received signal weaker. In order to compensate for the weak signal, broadcast television antennas are generally arranged to provide high gain in desired directions. The antenna is often a vertical array of a large number of bays of individual radiators which are fed with a phase and amplitude selected to provide maximum gain towards the most distant desired locations. Since the path loss from the antenna location to nearby viewers is less than the path loss to the most remote viewers, the gain of the antenna is allowed to decrease for depression angles (angles below the horizontal measured from that horizontal plane passing through the center of the antenna).

At one time all terrestrial television broadcast was by means of horizontally-polarized signals. In order to maximize revenues, television and broadcast sites are often located in or near an urban center. Because of the urban nature of the region near television broadcast sites, there tend to be large numbers of tall buildings in the vicinity of the receivers. As is known, these tall buildings reflect the television signals, causing the signal at any particular receiving location to be the sum of the direct-path signal and one or more reflected signals. This multi-path (antenna to reflecting object, reflecting object to receiver) signal is generally delayed relative to the direct signal because of the greater path length between the transmitting site and the viewer's site by way of the reflecting object. Reception of a delayed signal together with a direct signal results in the form of distortion commonly known as ghosting. Television viewers in the vicinity of the transmitting antenna site could equip their television receivers with low-gain indoor (rabbit ear) antennas. The rabbit-ear antennas commonly used by viewers at locations close to the television transmitting site do not discriminate well against multi-path signals, and therefore ghosting was and continues to be relatively common in television reception in urban areas. Suburban and other viewers at locations at a substantial distance from the transmitting site, on the other hand, ordinarily use rooftop antennas having a relatively high gain in order to provide a strong signal from the distant transmitter. Such high-gain receiving antennas discriminate well against multi-path signals, and ghosting is less of a problem in many suburban areas then it is in urban areas closer to the television transmitter site.

Attention has for several years been directed to the broadcasting of circularly-polarized signals from the television transmitter site in order to reduce the effects of ghosting and to provide a greater uniformity of coverage. Such circularly-polarized antennas generate substantially equal-amplitude vertically and horizontally polarized radiated fields in time quadrature, as is known in the art. One of the characteristics of a circularly-polarized signal is that the hand of polarization reverses when reflection takes place. Thus, the once-reflected signal arriving at a receiver location has a hand of polarization opposite to that of the direct-path signal. Consequently, a circularly-polarized receiving antenna adapted for receiving a particular hand of polarization rejects the once-reflected multi-path signal, therefore (ideally) eliminating ghosting. A twice-reflected signal, which has the same hand of polarization as the transmitted signal, is generally reduced in amplitude sufficiently so that the ghosting occasioned by its reception is not objectionable.

A major disadvantage of circularly-polarized broadcasting antennas is the need for double the transmitter power in order to maintain the horizontally-polarized field component of the circularly-polarized signal at the same magnitude as that of an equivalent horizontally-polarized antenna. Doubling of the transmitted power to accomodate a circularly-polarized antenna entails a very large continuing expenditure, which must be weighed against the number of increased viewers or the improvement in the received signal and resultant increased viewer satisfaction. The doubling of the transmitter power does not increase the area covered when a circularly-polarized broadcast antenna is used, because the horizontally-polarized radiated field has the same magnitude as a half-power horizontally-polarized broacasting antenna, and very few distant viewers have circularly-polarized receiving antennas. Rather, most of the remote antennas are horizontally-polarized, and therefore the vertically-polarized signal component arriving at the distant viewer's locations is not used. Consequently, circularly-polarized television broadcasting antennas have found only limited use.

Since some receivers may have only a vertical whip antenna capable of receiving only a vertical field component, a horizontally-polarized broadcast antenna cannot provide a receivable signal. In order to provide a vertical field component for such whip antennas and for viewers using (partially horizontally-polarized) rabbit ears in locations in which the horizontal fields are not existent due to cancellation effects, it is known to use a vertically-polarized monopole or dipole antenna located at the top of the main horizontally-polarized broadcast antenna array. However, while this provides a vertically-polarized field component, the phase and amplitude of the vertically-polarized field component relative to the horizontally-polarized component at any particular location is random because the relative phase of the vertically and horizontally polarized signals vary sharply with changes in radial distance from the broadcast antenna site because of the vastly different phase centers (apparent source of radiation) of the antennas for the two components. For example, an antenna including a 32λ (wavelength) vertically-oriented, horizontally-polarized array antenna having a phase center at its midpoint (16λ and a vertically- oriented dipole antenna located at the top of the array has its phase centers 16λ apart with both antennas mounted on a thousand-foot high tower (assumed to be 500 wavelengths long), about 13 complete 360° rotations of phase between the two received signal components can be found along a path between the base of the tower and a location one mile distant from the base of the tower. Referring to the wave polarization chart of FIG. 12*a*, (and regardless of the amplitudes of the two components) this phase variation corresponds to more than 20 excursions between 0 db axial ratio and infinite axial ratio (which corresponds to linear polarization). Further considering that the amplitudes of the vertical and horizontal signal components vary as a function of distance from the transmitting antenna, it can be seen that it is very difficult to predict the polarization at any particular location.

It is desirable to have an antenna which receives power from a transmitter and transmits the principal portion of the power to distant viewers in the form of horizontally-polarized signal, and which provides vertical and horizontal components in phase quadrature (ideally, provides circular polarization) to local viewers.

SUMMARY OF THE INVENTION

A broadcast antenna includes a vertical array of a plurality of bays of horizontally-polarized radiating elements arranged for relatively high gain towards distant locations. A low-gain array of vertically polarized radiators has its center near the center of the array of horizontally-polarized radiators and is fed with a small amount of power relative to horizontally-polarized radiators for providing horizontally-polarized radiation with high gain towards distant locations and radiation with vertical and horizontal polarization components approximately in phase quadrature towards nearby locations. Ideally, the amplitudes of the vertical and horizontal radiation components towards nearby locations is substantially equal so that nearby locations receive circular polarization.

DESCRIPTION OF THE DRAWING

FIG. 3*a* is a side elevation projection of the antenna bay of FIG. 2, FIG. 3*b* is another side elevation projection, and FIG. 3*c* is a plan view of the antenna bay of FIG. 2;

FIG. 4*a* represents vertical and horizontal polarization, and FIG. 4*b* is an axial-ratio pattern;

FIG. 5*a* represents horizontal polarization by a solid line and vertical polarization by a dashed line, and FIG. 5*b* is an axial-ratio pattern;

FIG. 6*a* illustrates details of the coupling mechanism for the slot element as shown in FIGS. 1*a, b* and *c,* in FIG. 2, and in FIG. 3*a,* viewed from inside the transmission line portion of the antenna shown in those FIGURES, and FIG. 6*b* is a sectional view of the portions of the antenna illustrated in FIG. 6*a;*

FIG. 7*a* illustrates the details of the mounting arrangement for a parasitic radiating element illustrated in FIGS. 1*a,* 1*b,* 2, 3*a,* 3*b* and 3*c,* and FIG. 7*b* is a sectional end view of the antenna illustrating the orientation of portions of the mounting arrangement of FIG. 7*a;*

FIG. 8 lists the dimensions of the slots, slot center-line separation, coupler diameter and the thickness of the bar on which the coupler is mounted, for each layer or bay of a channel 31 pylon antenna which forms a part of an embodiment of the invention;

FIG. 10*a* tabulates the amplitude, and FIG. 10*b* tabulates the phase of the horizontally-polarized field component radiated by the pylon antenna, the dimensions of which are tabulated in FIG. 8;

FIG. 10*c* tabulates the illumination, FIG. 10*d* tabulates the field amplitude, and FIG. 10*e* tabulates the field phase of the vertically polarized field component radiated by an antenna according to the invention;

DESCRIPTION OF THE INVENTION

Figures 1A, 1B, 1C:
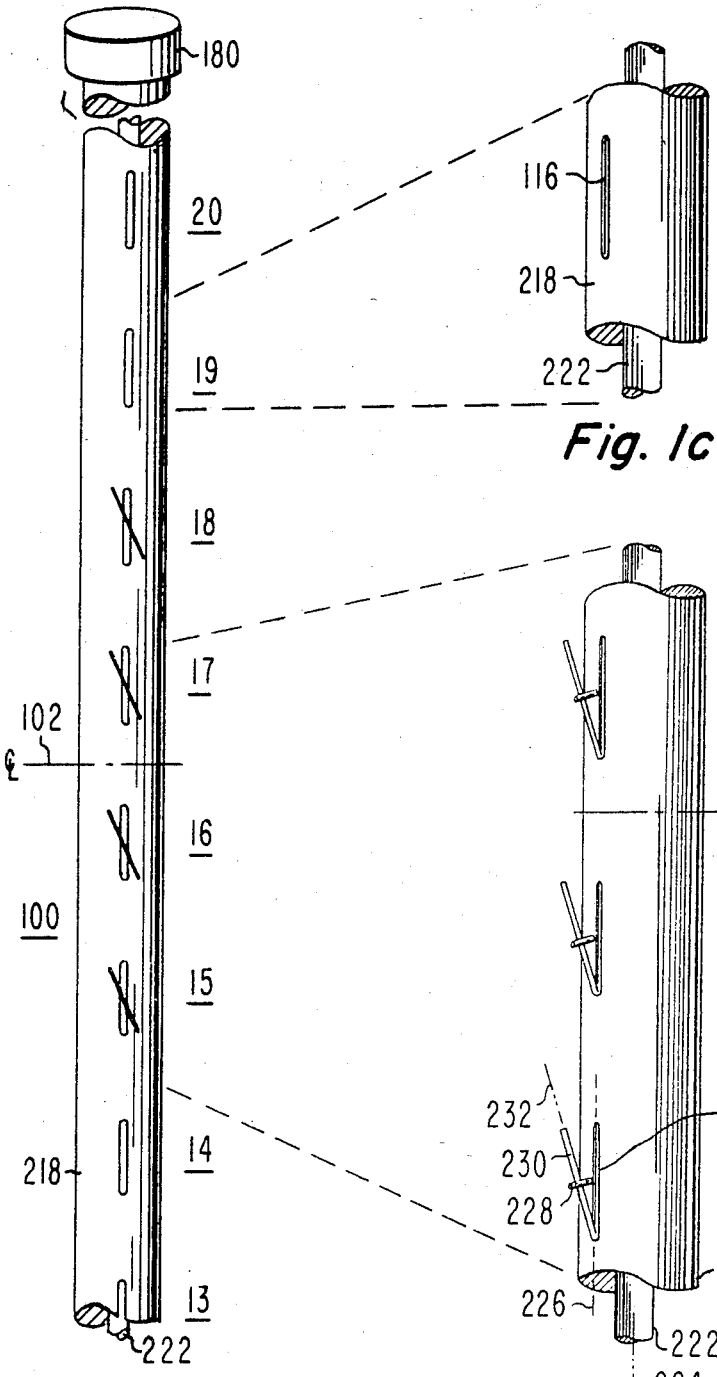
FIG. 1*a* illustrates, in perspective, a portion of a vertical array of radiators according to the invention.
FIG. 1*b* illustrates bays 15, 16 and 17 of the arrangement of FIG. 1*a* in more detail.
FIG. 1*c* illustrates bay 19 of the arrangement of FIG. 1*a* in more detail.

In FIG. 1, an antenna designated generally as 100 includes a vertically-oriented coaxial transmission line having a center-conductor 222 and a conductive outer conductor 218. Outer conductor 218 has an array of 32 bays 1–32 each including a slot radiator, of which only the slot radiators associated with bays 13 through 20 are illustrated. A center-line or plane 102 divides the 32 bays into 16 bays (1–16) below the center line and 16 bays (17–32) above the center line. The center-to-center separation between the bays is approximately one wavelength at the frequency of operation as tabulated below. Bays 15, 16, 17 and 18 which are near center line 102 differ from the remaining 28 bays, in that they include parasitic radiators 230. As known, the transmission line is terminated by a matched terminator or a reactive terminator 180. FIG. 1*b* illustrates bays 16, 17 and 18 in more detail, and FIG. 1*e* illustrates bay 19 in more detail.

Figure 2:
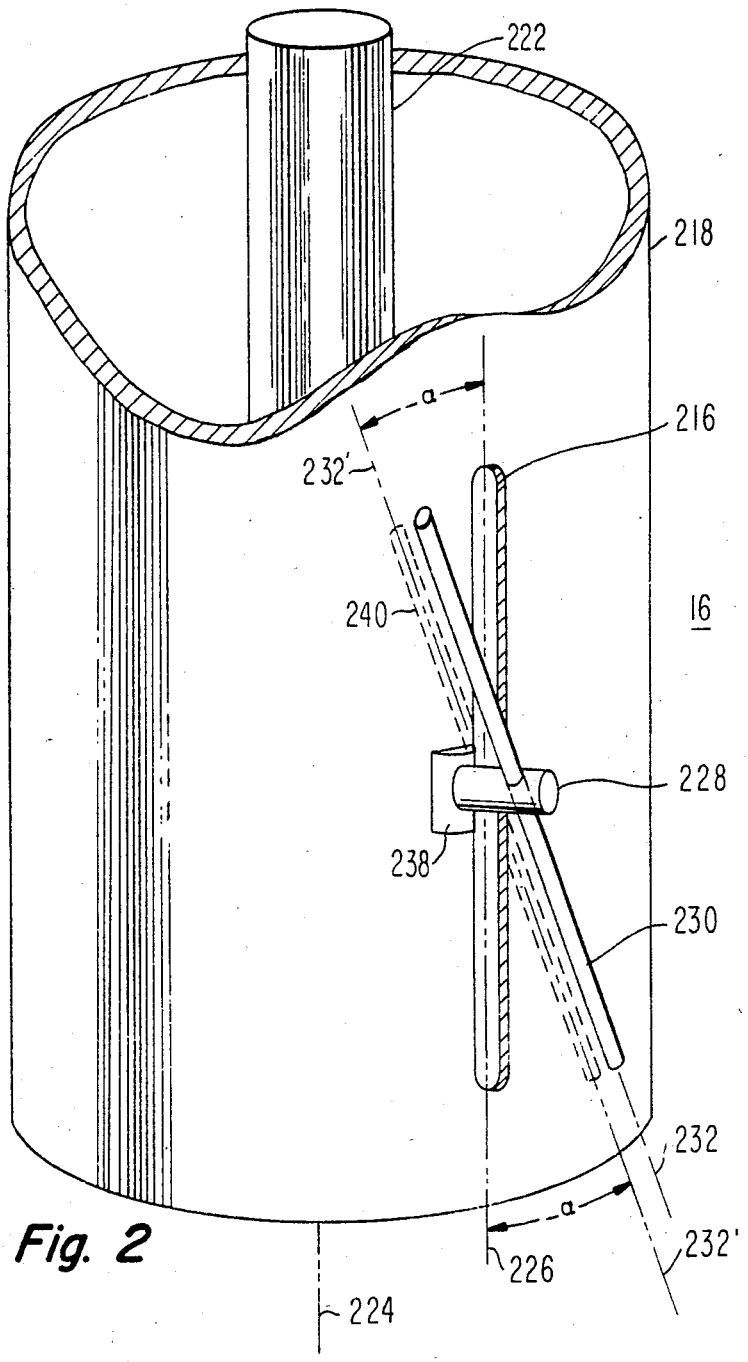
FIG. 2 illustrates in perspective view yet more detail of bay 16 of the arrangment of FIG. 1.

FIG. 2 illustrates bay 16 in more detail. Slot 216 is parallel to central axis 224. Parasitic radiator 230 passes through a hole in dielectric support cylinder 228 and is supported in a position away from the outer surface of outer conductor 218. Dielectric support 228 is in turn mounted upon and supported by a mounting arrangement 238 described in greater detail in conjunction with FIG. 7.

Also illustrated in FIG. 2 is the outline 240 of the projection onto outer conductor 218 of parasitic element 230. The projection is along a radial direction relative to the generally cyclindrical structure of the coaxial transmission line (i.e., the projection is directed parallel to a radial line extending perpendicularly from axis 224 through the center of slot 216). For simplicity, the curvature of the projection due to the curvature of outer conductor 218 is not shown. The axis 232' of projection 240 lies along outer conductor 218. The angle minus $\alpha$ ($-\alpha$) between axis 226 and axis 232' defines a deviation or skew angle between the axis 232 of parasitic element 230 and the axis 224, or between parasitic element 230 and the longitudinal direction of the slot. This angle is selected to be in the vicinity of 6° for reasons described below and in a copending application entitled CIRCULARLY POLARIZED ANTENNA USING AXIAL SLOT AND SLANTED PARASITIC RADIATORS Ser. No. 646,422 filed Aug. 31, 1984 in the name of T. V. Sikina, Jr.

FIG. 3 illustrates three orthogonal projections of the bay illustrated in FIG. 2. The elements of the bay as illustrated in FIG. 3 have already been described in conjunction with FIGS. 1 and 2. Taken by itself, the bay illustrated in FIGS. 2 and 3 produces circularly polarized radiation (or nominally circularly-polarization radiation, which is elliptical polarization with low axial ratio), by generating two orthogonally-polarized vectors or fields which are equal in amplitude, and which are in phase quadrature. The first of the two orthogonal vectors is the horizontally-polarized vector produced by direct radiation from the slot. While ordinarily described as radiation "from a slot", the slot actually excites the surrounding conductive surface, and it is the outer conductor or mast itself which carries current and which radiates. Thus, the first or horizontally polarized vector is radiated by excitation of the mast by the slots. The second of the vectors is the summation of the vertical components of the fields re-radiated by parasitic radiator 230 and the vertically polarized field component reflected or re-radiated by outer conductor 218 as a result of radiation from parasitic element 230.

As can be seen in FIG. 2, when angle $\alpha$ is small, parasitic element 230 overlies essentially the same portion of outer conductor 218 into which axial slot 216 is cut. The slot excites the mast with currents giving rise to horizontally-polarized radiation, and the parasite excites the mast with currents giving rise to vertically-polarized radiation. Because of the similarity in size and positioning of the slot and the parasite relative to the outer conductor, it is reasonable that if the magnitudes of the signals induced into the mast are the same, the mast radiation of the vertical and horizontal components will be the same, except for those boundary conditions of mast current which depend upon the direction of current flow. The magnitudes of the vertical and horizontal fields may be substantially equal if the coupling factor between the parasitic element and the slot approaches unity. A near-unity coupling factor is achieved at a radial separation distance between parasitic element 30 and slot 16 which is approximately 0.1 wavelength.

In order to achieve circular polarization the vertical and horizontal field components must be in phase quadrature. Phase variation between the directly-radiated horizontal and re-radiated vertical components of the field results from the reactance of the parasitic element. As known, the reactance is a function of the length of the parasitic element. The hand of polarization, the magnitude of the two orthogonal field vectors, and phase therebetween can be established by the orientation of parasitic element 230, the parasite angle $\alpha$, and the length of the parasitic element.

The effect of changing angle $\alpha$ can be explained as follows. If $\alpha$ is small or zero, parasitic element 230 has no length component parallel to the horizontally-polarized field of slot 216. Consequently, there is no coupling of energy into parasite 230 and no vertically-polarized radiation. The sum field is then horizontally polarized. As $\alpha$ is increased to about 6°, the amount of energy coupled into the parasite and the resultant re-radiation increases, but $\alpha$ is small enough so that most of the re-radiated power goes into vertical polarization and very little into horizontal polarization (i.e., the magnitude of the horizontally-polarized parasitic radiating component is proportional to sin $\alpha$ and for values of $\alpha$ near 6°, sin $\alpha$ is about 0.1). As $\alpha$ increases well past 6°, more energy is coupled into the parasitic element, but proportionally more of that energy is re-radiated as horizontal rather as the desired vertical polarization. It can understood from this discussion that values of $\alpha$ near but not equal to 6° may also provide the desired conditions for axial ratio.

The radiation patterns of FIGS. 4 and 5 were made at 819 MHz on an antenna similar to that of FIGS. 2 and 3 with the following dimensions:

| | |
|---|---|
| Inner conductor diameter | 1.75" (4.45 cm) |
| Outer conductor diameter | 6.5" (16.5 cm, 0.445λ) |
| Slot length | 6.5" (16.5 cm) |
| Slot width | 1.0" (2.54 cm) |
| Parasite length | 6.14" (15.6 cm) |
| Parasite diameter | 0.25" (6.4 mm) |
| Parasite-to-mast separation (measured from center of parasite) | 1.0" (2.54 cm) |

Figure 4A:
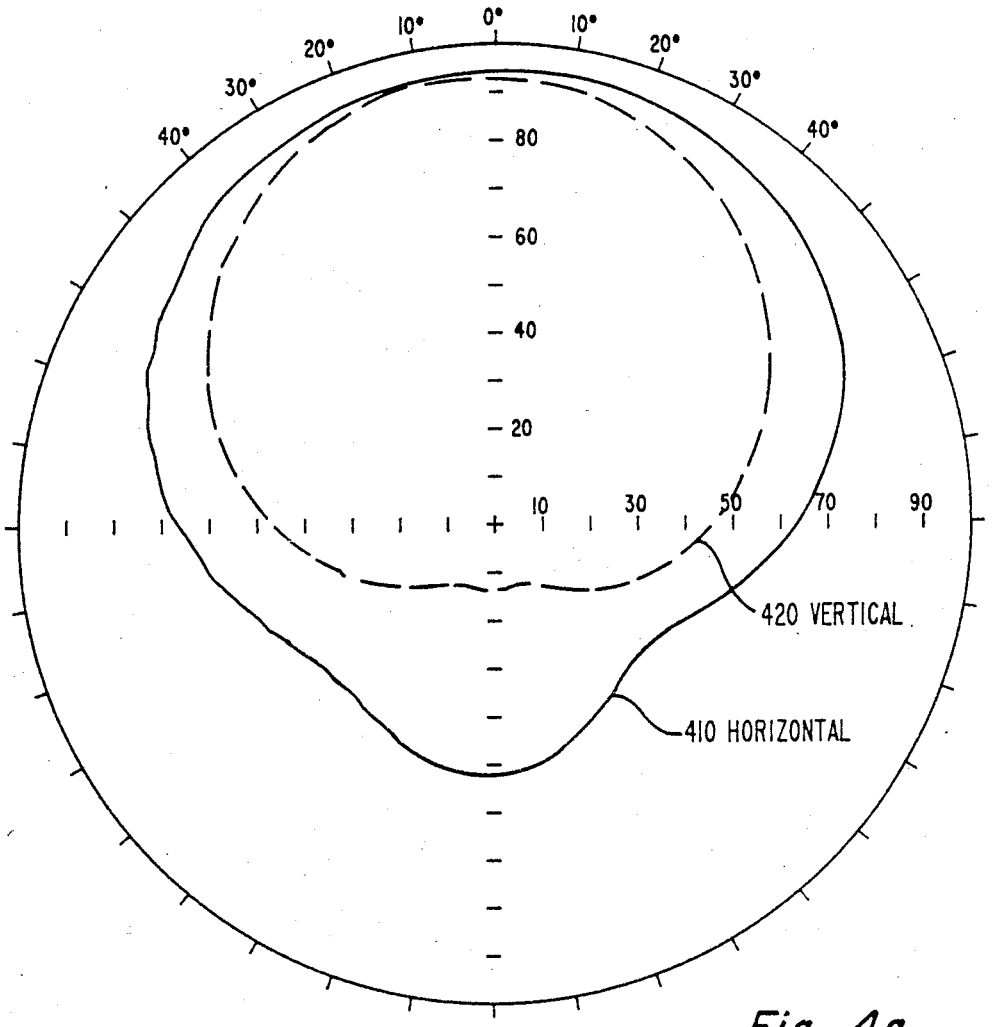
FIGS. 4*a* and 4*b* illustrate linear-amplitude azimuth-plane polar radiation patterns of the antenna illustrated in FIGS. 2 and 3.
Figure 4B:
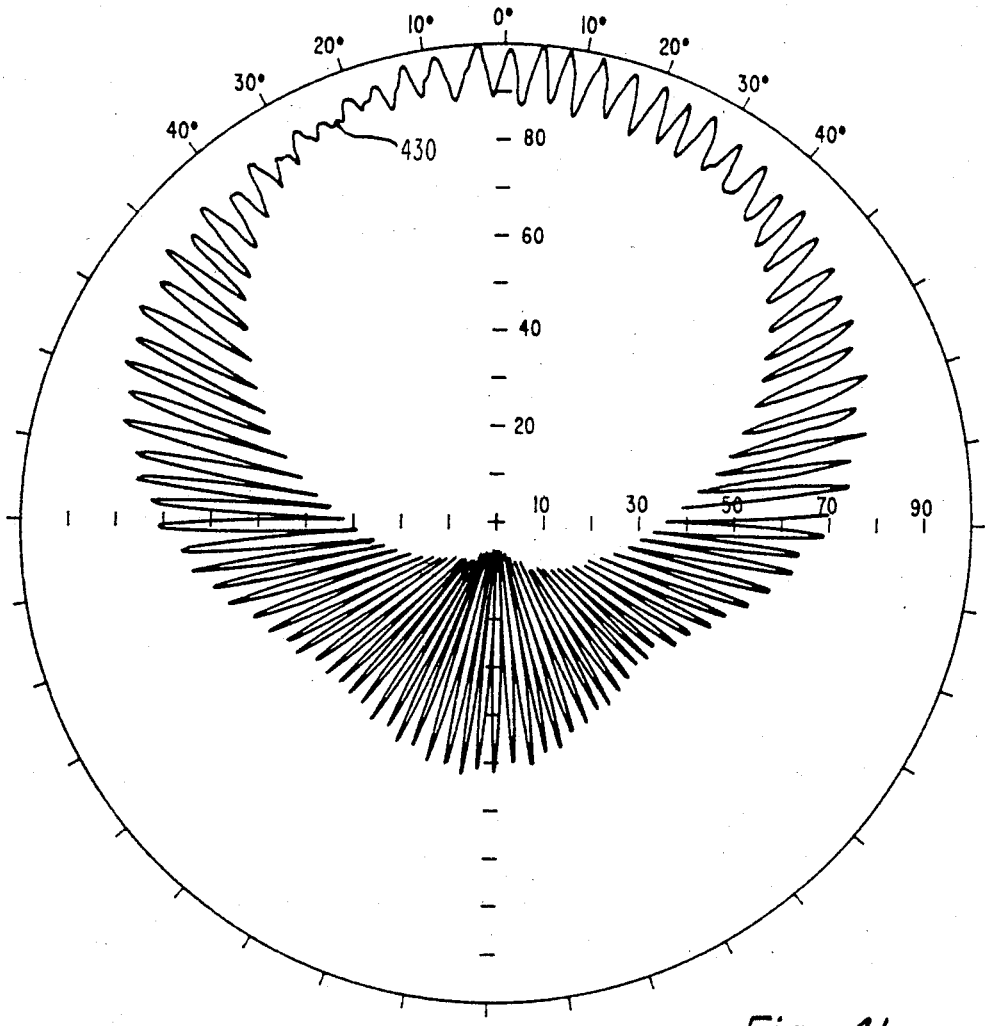
Figure 5A:
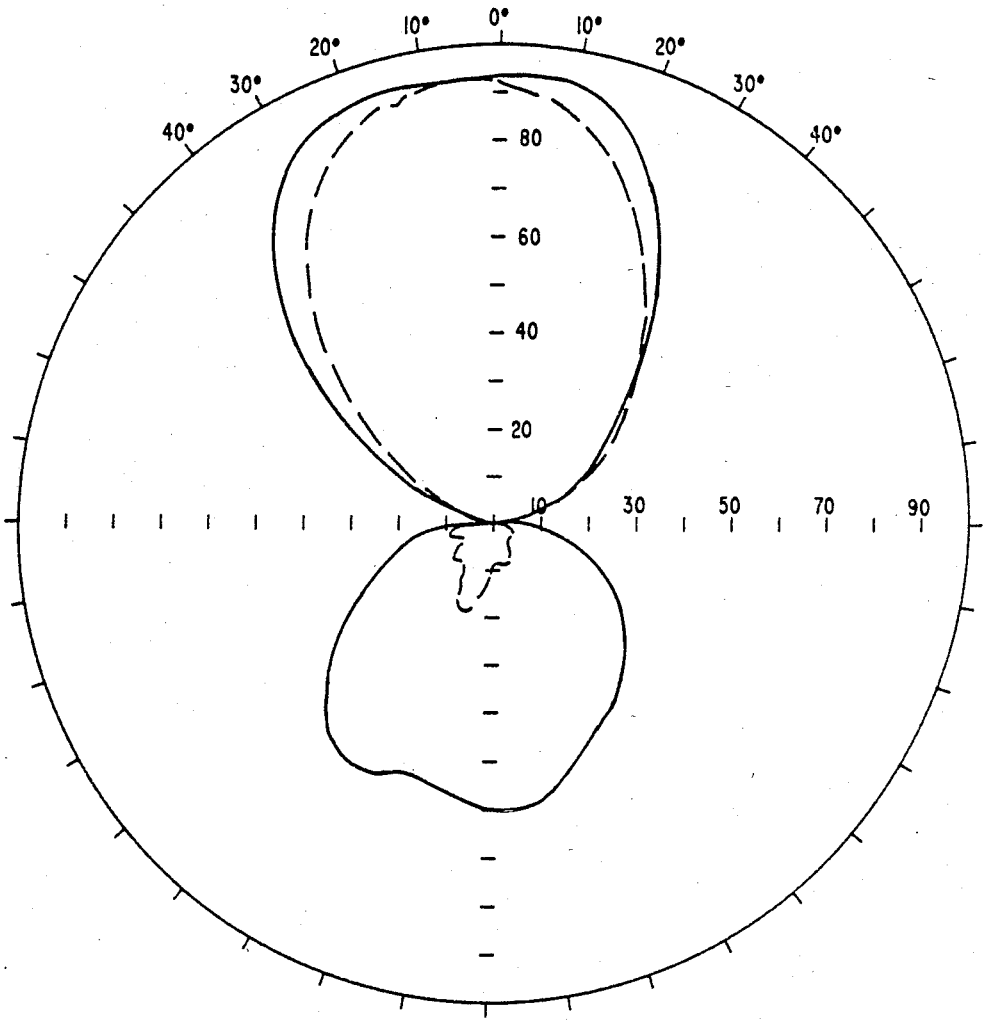
FIGS. 5*a* and 5*b* illustrate linear-amplitude elevation plane polar radiation patterns of the antenna illustrated in FIGS. 2 and 3.
Figure 5B:
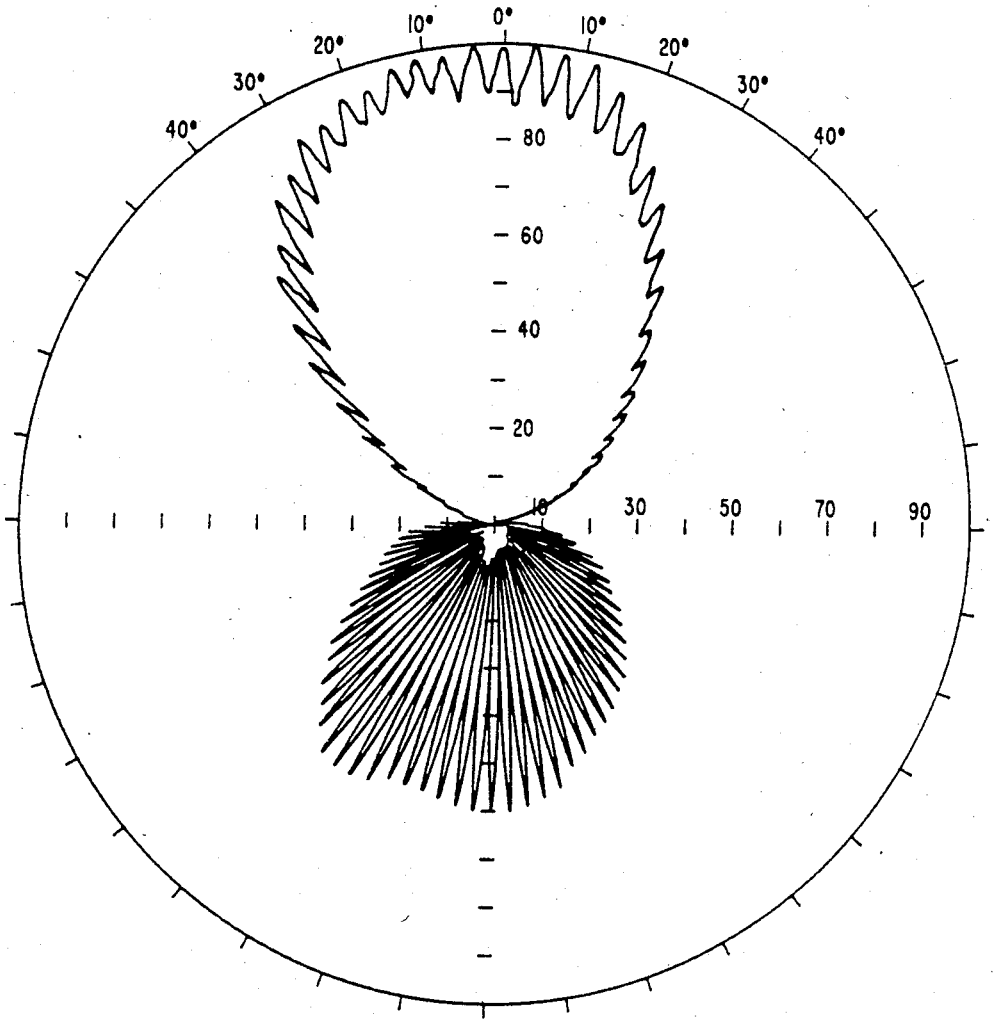

In FIG. 4*a*, the dashed lines represent vertical polarization and the solid lines represent horizontal polarization. It can be seen that at 0° (corresponding to the radial line passing through the center of the slot) the vertical and horizontal polarization components of the radiated field are almost equal. FIG. 4*b* illustrates an axial-ratio polar plot of a radiation pattern corresponding to the vertical and horizontal-polarization radiation pattern of FIG. 4*a*. An axial-ratio pattern differs from a linear-polarization pattern in that a rotating linearly polarized antenna is used for transmitting to (or receiving from) the antenna under test. In FIG. 4*b*, it can be seen that the axial ratio approaches unity (0 db) at a point 430 approximately 22° off axis, to the left side as viewed in FIG. 4*b*. The axial ratio at 0° is 20 $\log_{10}$ (1.00/0.88)=1.11 dB. FIG. 5*a* is a linear polar plot of elevation-plane vertical and horizontal components of the radiation field of the antenna of FIGS. 2 and 3. FIG. 5*b* is an axial-ratio polar plot in the elevation plane passing through the 0° axis.

While various coupling arrangements are possible for coupling energy from the TEM wave within the coaxial transmission line to the slot, as described for example in U.S. Pat. No. 2,981,947 issued Apr. 25, 1961 to Bazan, a particularily advantageous form of coupling element is illustrated in FIG. 6. In FIG. 6*a*, a portion 620 of outer conductor 218 together a slot 216 cut therethrough is illustrated in perspective view as seen from inside the transmission line. A conductive coupler in the form of a circular cylinder 675 having a length approximately equal to that of the slot is mounted adjacent to slot 216 by means of a conductive spacer or coupling bar 678 having an approximately rectangular cross-section. This arrangement is used when the diameter of a simple cylindrical coupler illustrated by broken-line outline 676 in FIG. 6*b* required for coupling the proper amount of energy to the slot exceeds the width W of slot 216, which would prevent the coupler from being introduced into the interior of the transmission line from the outside. The diameter D1 of the desired coupler is simulated by the combination of cylindrical coupler 675 having diameter D2 together with coupler bar 678 having a thickness T. As known, the various elements may be coupled together by welding, brazing or by the use of fasteners such as screws.

FIGS. 7*a* and 7*b* illustrate in perspective and sectional views, respectively, a mounting arrangement for the parasitic element which allows easy adjustment of the angle $\alpha$ at which the parasitic element is oriented. In FIG. 7, a bracket 710 supports parasitic element 730 (only a portion of which is shown) at a $\alpha$ angle of about 0°. Bracket 710 has a portion 708 which is flat and which bears against outer conductor 718, and a portion 706 at an angle to portion 708. A dielectric rod 728 is fastened to portion 706 of bracket 710 by a screw 707 threaded into the base of rod 728. Rod 728 may be made from any one of a number of materials such as polytetrafluoroethylene (TEFLON) which are transparent to radio-frequency signals. The center of parasitic element 730 passes through a hole 729 bored laterally through rod 728 near the end of the rod. Parasite 730 may be held in place in hole 729 by adhesive, by a locking screw 731 threaded into the end of rod 728 and bearing against parasite 730, or by other means. A bolt 750 is threaded through a threaded hole 704 formed in outer conductor 718 and locked in place by means of a lock washer 703, effectively forming a threaded stud on the outside of outer conductor 718. Bracket 710 is mounted onto the threaded end of screw 750 for rotation about axis 705. As bracket 710 is rotated, parasite 730 tilts, and small changes in angle $\alpha$ can be made without substantial change in the longitudinal position of parasite 730 with respect to slot 716.

As so far described, it can be seen that the antenna of FIG. 1 may be viewed as a vertical array of four bays of the low-gain circularly-polarized antenna of FIGS. 2 and 3 having a phase center at center line 102, together with a further array of horizontally-polarized slot antennas 1–14 and 19–32 also having a phase center at center line 102. An alternative, view is that the antenna of FIG. 1 consists of a vertical array of 32 bays of horizontally-polarized slot antennas having phase center at center line 102, upon which is superimposed a vertical array of four vertically-polarized radiators.

FIG. 8 tabulates the dimensions for a 32-bay pylon (slotted-cylinder) antenna having a pole diameter of 14" designed to provide 26 db of gain relative to a dipole (28 db relative to a horizontally-polarized isotropic source) at television channel 31 (573.25 MHz picture carrier, $\lambda=20.6''$). This tabulated data is for a commercial RCA Model TFU 25G antenna. This antenna can form the basis for an antenna according to the invention. The tabulated data includes the slot center-line-to-center line separation, the slot length, the coupler diameter and the thickness of the coupler bar, if any. It can be seen that the center-to-center slot separation (the separation between bays) approximately 20", the slot length ranges from 10.75" to 13.875" (corresponding to approximately one-half wavelength), and the coupler diameters range from 0.625" to effectively 1.75". These values are selected to provide the appropriate amplitude and phase variation of the signals radiated from the various slots (the array illumination). Among the considerations are a tapering of the illumination amplitude towards the upper and lower ends of the array in order to select the amplitudes of sidelobes of the radiation pattern. For this purpose, the amount of energy coupled from the transmission line for bay or layer numbers 1 (the lowermost bay) and 32 (the uppermost bay) is small, as evidenced by the relatively small coupler diameter for those layers, and the energy coupled to center bays 15–18 is large, as evidenced by the large coupler and bar dimensions. Another consideration is complex conjugate feeding of the slots; for every slot above the array centerline fed with a particular amplitude and phase, a corresponding slot below the centerline is fed with substantially the same amplitude and the negative of that phase.

Figure 9:
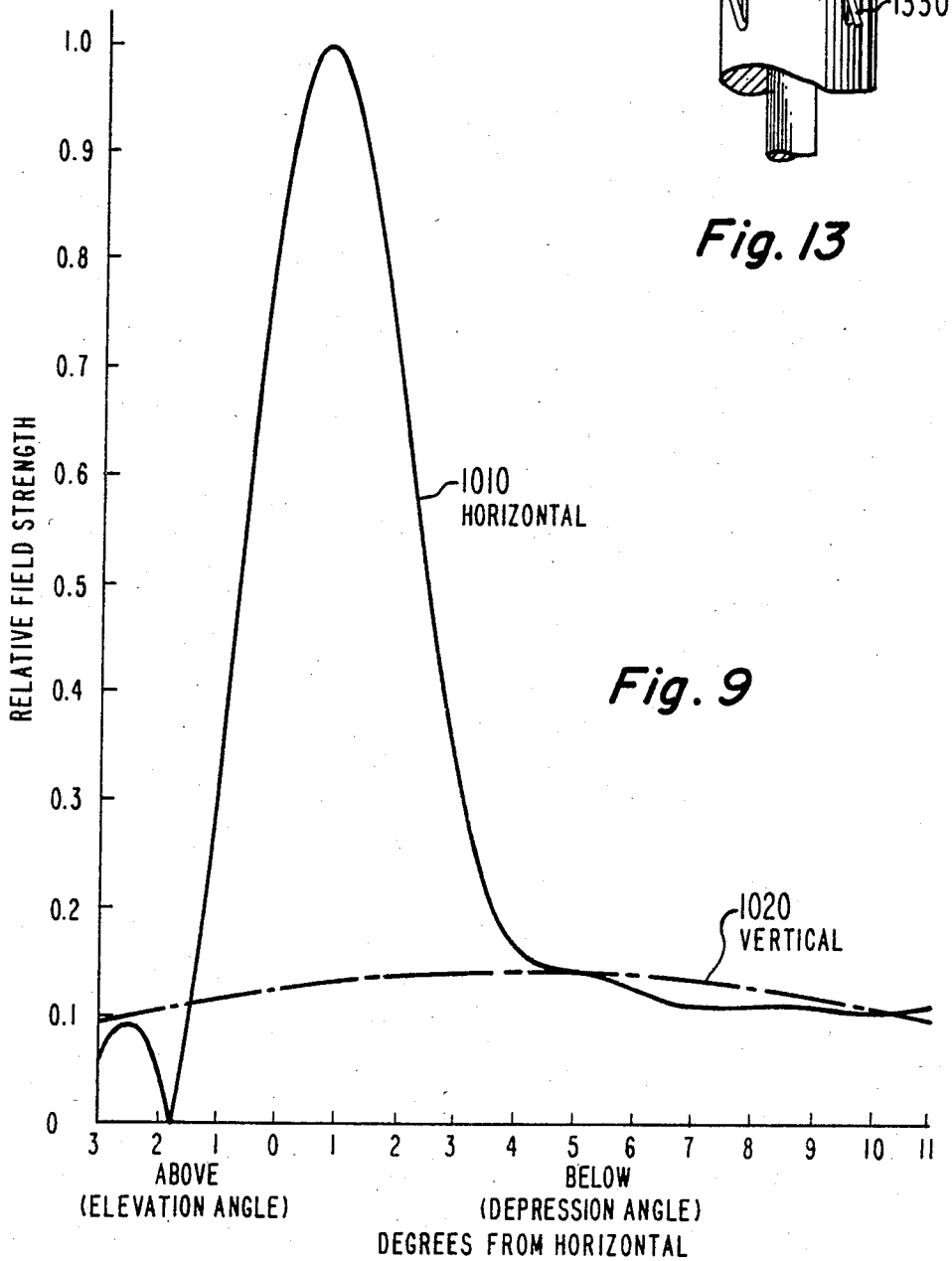
FIG. 9 is a linear elevation plot of the horizontally-polarized radiation component of the antenna illustrated in FIG. 1*a* for which the dimensions are tabulated in FIG. 8, and also includes a plot of the vertical radiation component.
Figure 11A:
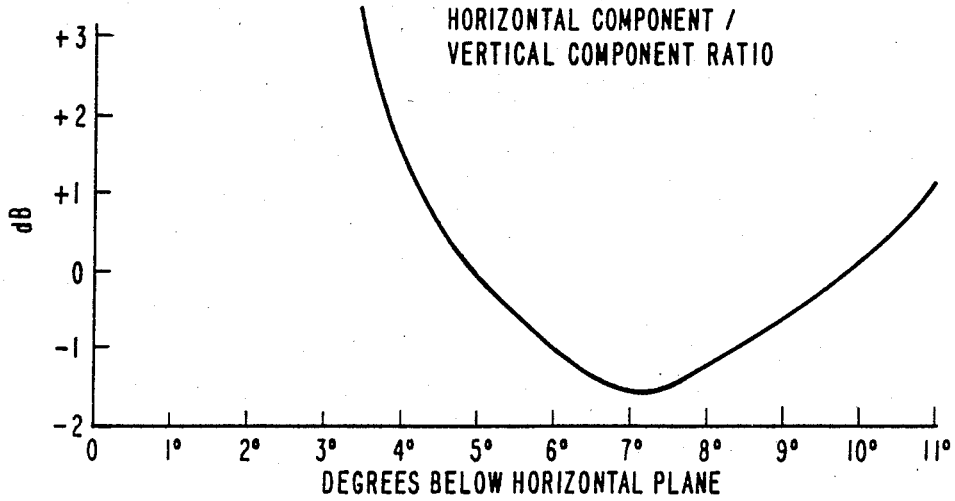
FIG. 11*a* is a plot of the ratio of the amplitude of the horizontal field component to the vertical field component versus depression angle.
Figure 11B:
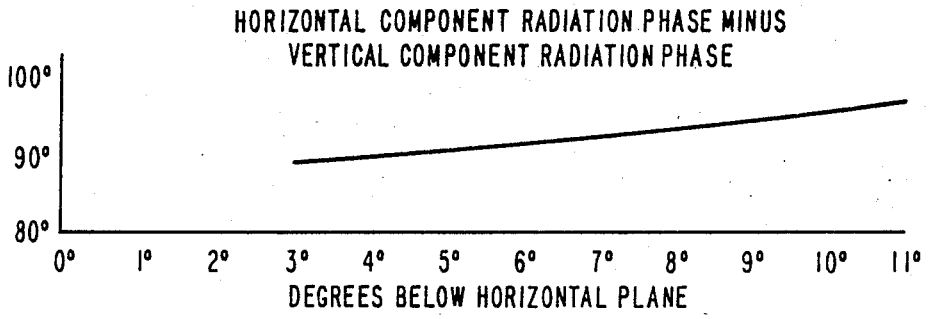
FIG. 11*b* is a plot of the phase of the horizontal field component minus the phase of the vertical field component versus depression angle.
Figure 11C:
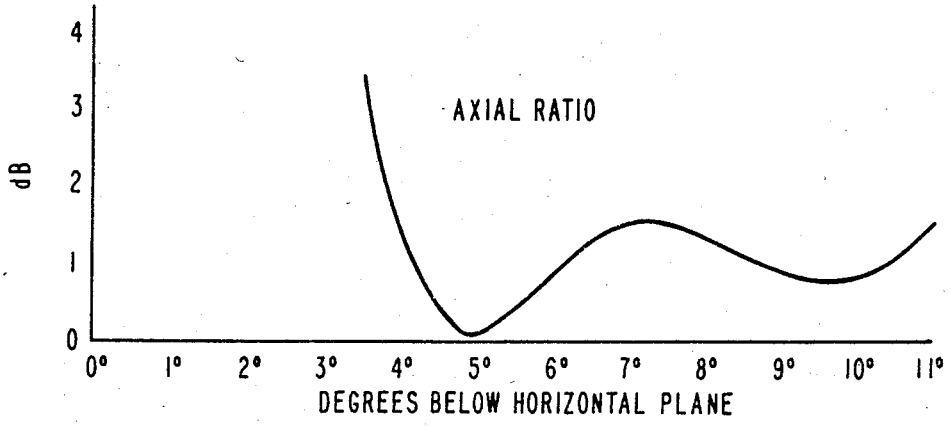
FIG. 11*c* is a plot of axial ratio versus depression angle, all for an antenna according to an embodiment of the intention, as illustrated in FIG. 1*a* and as tabulated in FIGS. 8, 10*a,* 10*b,* 10*c,* 10*d* and 10*e;*

The horizontally-polarized slotted-cylinder antenna having dimensions tabulated in FIG. 8 produces a radiation pattern which is ideally omni-directional in azimuth, and which has an elevation pattern illustrated as 1010 in FIG. 9 and the amplitude and phase of which are tabulated in FIGS. 10*a* and 10*b* respectively. Since FIG. 9 includes a plot of the vertically polarized antenna array illustrated in FIG. 1 and therefore relates to the invention, FIG. 9 is not labeled prior art. Linear amplitude horizontally-polarized radiation pattern 1010 is normalized to unity amplitude at the peak, which corresponds to a gain of 26.37 db relative to a dipole. The beam peak is 0.744° below the horizontal. It will be understood that the beam peak represents radiation directed towards the most distant viewers. If it is assumed that the antenna is placed a thousand feet above a flat surface, a depression angle of 0.7° corresponds to a line-of-sight to points at a distance of about 15 miles. The amplitude of the horizontally-polarized energy decreases sharply with increasing depression angles, reaching a relative amplitude of 0.2 (−14 db) at a depression angle of about +3.5°. It can be seen that for depression angles from about 4°–11°, the amplitude of the horizontal component remains relatively constant.

The above-mentioned pylon antenna is made into an embodiment of the invention by the addition of vertically-polarized radiators as illustrated in FIG. 1. The placement of vertically-polarized radiators having centers superimposed upon the center of the horizontally-polarized antenna as shown in FIG. 1 is advantageous because the wind load on the vertically-polarized antenna located at the physically lower center of the horizontally-polarized array is one-fourth the wind load which the same vertically-polarized antenna would have if located at the top of the horizontally-polarized antenna. In addition, the arrangement is advantageous because in the case of driven vertically polarized radiators (embodiment not illustrated) the vertically-polarized antennas are closer to the feeding center, thereby requiring less transmission line then would be required for feeding to a vertically-polarized antenna mounted at the top of the horizontally-polarized array.

A further advantage of congruent vertical and horizontal phase centers may be realized when the horizontally-polarized antenna has relatively constant amplitude and phase in the "null fill" region below the major portion of the beam, as for example between 4° and 11° in FIG. 9 because the phase relationship between vertically and horizontally-polarized components at various receiving locations may be better controlled to give circular polarization. It will be noted from FIG. 10*b* that the phase of the horizontally-polarized component relative to the beam peak in the region between 3.5° and 11° is 0° (i.e., the phase of the radiated signal at a constant distance from the phase center of the antenna remains constant, which is another way of saying that lines of constant phase are centered on the phase center of the antenna). If the vertically-polarized field components have an amplitude substantially equal to that of the horizontal component in the region from 4° to 11°, and are in time quadrature therewith, circular polarization will result. Thus, if the four parasitic elements of bays 15–18 are arrayed in such a manner as to produce the desired amplitude and phase, the region from 4° to 11° will be circularly-polarized (actually, elliptically polarized with low axial ratio, which is commonly called circular polarization).

While it is very advantageous as described above to have coincident phase centers for the vertically- and horizontally-polarized antennas, small deviations make no significant difference at large distances from the antenna, and cause little phase error at short viewer distances, so may be disregarded.

Centering the vertically-polarized array on the horizontally-polarized array as illustrated in FIG. 1 creates two problems: (1) the power radiated from the central bays of the horizontally-polarized array may be too great for optimum amplitude ratio of the reradiated vertically-polarized component, as further described below; and (2) the illumination taper of the centrally-located bays which is essentially the illumination taper of the array of parasitic elements, may not generate the desired reradiated vertically-polarized radiation pattern, which in turn may create the need for some way to adjust the illumination and thereby impact the array factor of the horizontally-polarized antenna. A more practical arrangement takes advantage of the slightly lower power and illumination taper of the slots of bays 20 to 23 to drive the parasitic elements. Thus, the center of the vertically-polarized antenna is above the centerline of the horizontally-polarized array by about five wavelengths but this does not significantly degrade the antenna performance at either far or near distances for the reasons stated above.

Plot 1020 of FIG. 9 illustrates the vertically-polarized radiation pattern resulting from the array of four vertically-polarized elements of bays 20–23 of FIG. 1. The four-bay vertically-polarized antenna has a gain of 4.05 dB/dipole and a beam tilt of 3.97°. FIG. 10*c* lists the normalized illumination, and FIGS. 10*d* and 10*e* tabulate the amplitude and phase, respectively of the field. It should be noted that the value 51.92°, which is the phase-shift imparted to the vertical radiation component by the reactance of the parasitic reradiating element, should be added to each of the tabulated values of phase in FIG. 10*e*.

Figure 12C:
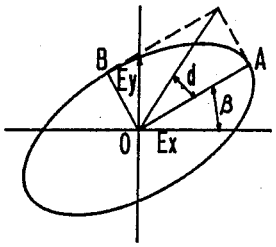
FIG. 12*c* is an illustration of a polarization ellipse defining parameters used in the charts of FIGS. 12*a* and 12*b.
Figure 12A:
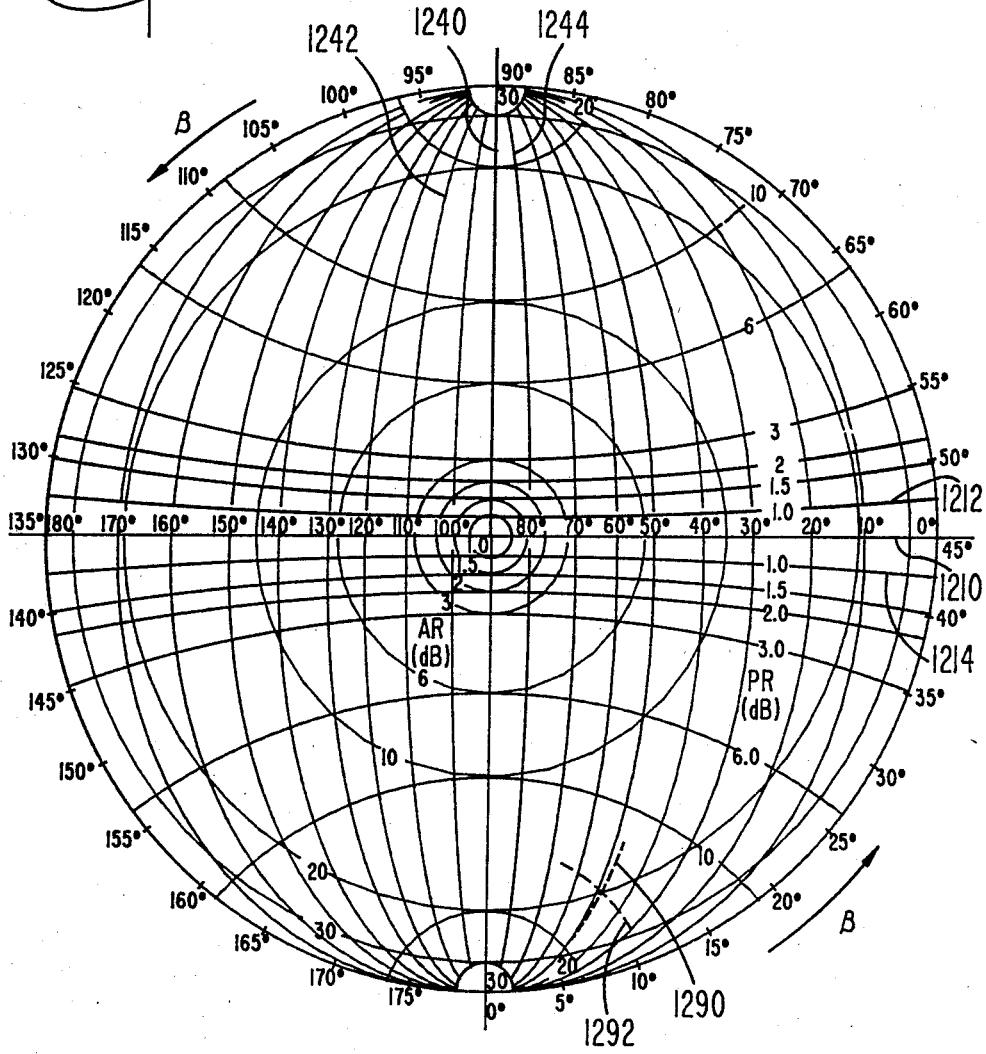
FIG. 12*a* is a chart by which the axial ratio can be determined from the relative amplitudes and phases of the vertical and horizontal field components.
Figure 12B:
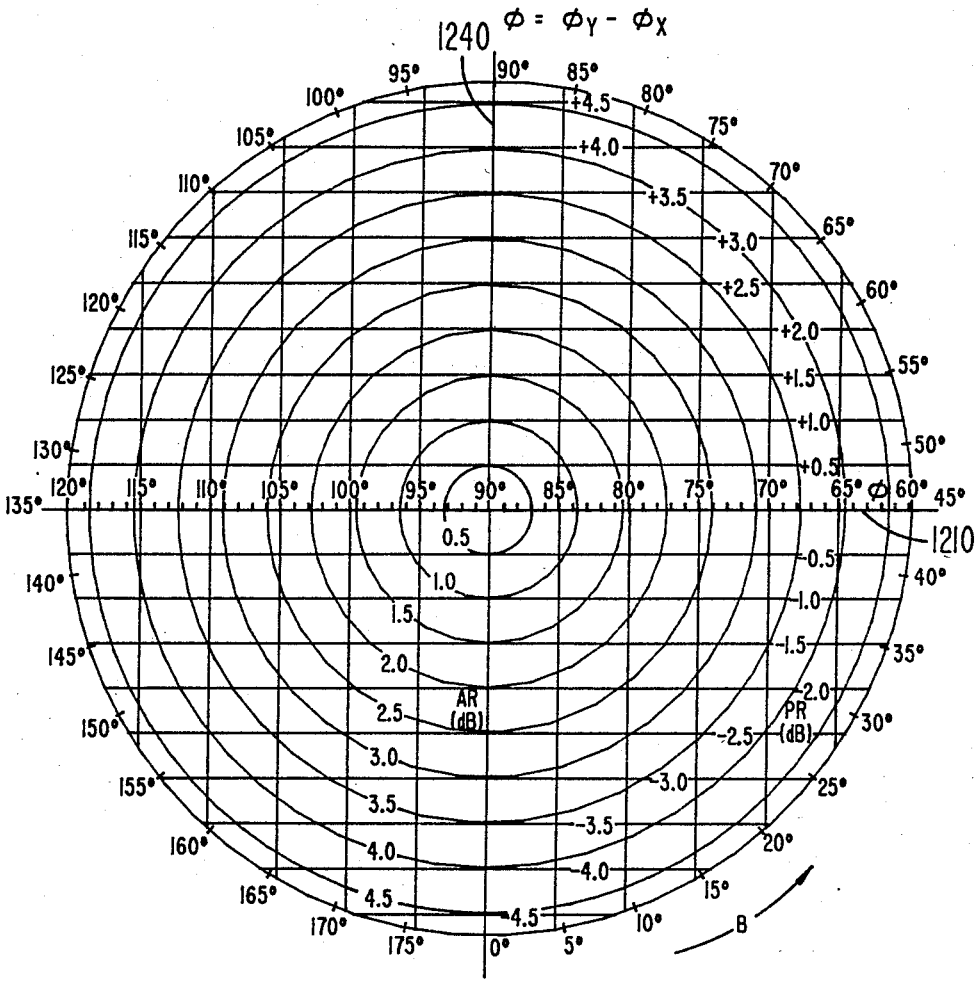
FIG. 12*b* is an expansion of the central portion of FIG. 12*a* showing more detail.

FIG. 12*a* is a wave polarization chart aiding in quickly determining the axial ratio resultant from a given relative amplitude and phase angle between vertical and horizontal field components. In FIGS. 12*a* and 12*b*, the concentric circles about the center are circles of constant axial ratio. Line 1210 passing horizontally through the center and lines 1212, 1214, etc., approximately parallel thereto are lines of constant amplitude relationship between vertical and horizontal components. Line 1240 passing vertically through the center of the chart of FIGS. 12*a* and 12*b* and lines 1242, 1244, etc. approximately paralleled thereto are lines of constant phase-angle difference between the vertical and horizontal components. In order to determine the axial ratio resulting from a given amplitude difference and phase angle between the vertical and horizontal components, proceed by determining the amplitude difference in db and the phase angles in degrees and locate on the chart the point of intersection, and then determine the axial ratio from the concentric circle corresponding to that point. For example, for equal-amplitude vertical and horizontal components (zero dB polarization ratio) and a 34° phase difference therebetween, enter the chart from the right on line 1210 and proceed to the 34° mark; read axial ratio of 10 db from the concentric circles. The corresponding angle $\beta$ (see FIG. 12*c*) is 45°. As a second example, for a 90° phase difference and a vertical component twice as large as the horizontal component, determine the amplitude of the polarization ratio in decibels (6 db) and enter the chart at the top of line 1240, proceeding downward to the 6 db line. From the concentric circles, read an axial ratio of 6 db and angle $\beta$ of 90°. As a third example, consider the case of a horizontal component 18 db greater than the vertical, with a phase angle of 45° therebetween; noting that the polarization ratio is negative (because vertical is smaller than horizontal), enter the lower portion of the chart and interpolate between the $\Phi=40°$ and $\phi=50°$ lines to a line such as 1290 and find the intersection with an estimated line 1292 representing approximately 18 db ratio. The intersection of lines 1290 and 1292 corresponds 20 db axial ratio, and the angle $\beta$ is about 6°. The chart of FIG. 12*b* is an expanded version of the center of FIG. 12*a*.

From FIG. 9, the relative V/H amplitude at a depression angle of 4° is $0.142/0.160=-1.03$ dB and the phase relative to the phase of the horizontally-polarized radiation is $38.1°+51.92=90.02°$, while at 11° depression angle the polarization ratio is $-0.73$ dB and the relative phase is $44.5°/+51.92=96.42°$. The ellipticity of the resultant radiation may be determined by using FIG. 12. At 4° depression angles the axial ratio is about 1.03 dB, and at 11° about 1.2 dB. These are relatively low axial ratios suitable for television broadcast applications.

Figure 13:
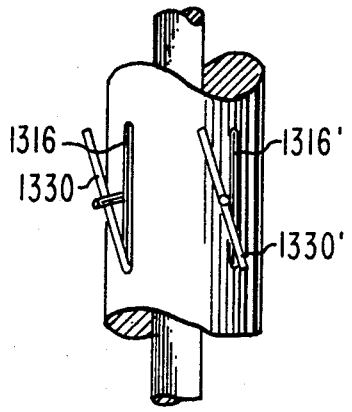
* and FIG. 13 illustrates a bay for the antenna shown in FIG. 1 including more than one slot and parasitic element.

As illustrated in FIG. 13, each bay may include a plurality of slots 1316, 1316' as may be required in view of the desired azimuth radiation pattern. Naturally, if the bay is to include vertically-radiating components, additional parasitic elements 1330, 1330' may be included.

It will be recognized that the parasitic elements absorb horizontally-polarized energy and re-radiate it in the form of vertically polarized energy to produce the radiation pattern 1020 of the vertically polarized components. As may be readily established from FIG. 9, the relative field intensity at the beam peak of the vertical component relative to the peak value of the horizontal is approximately 14%. If the beam widths of the vertical and horizontal polarized radiation patterns were the same, the amount of energy in the vertically-polarized field would be proportional to $(0.14)^2$ squared, which is approximately 2%. However, the vertically-polarized radiation extends over a larger solid angle then does the horizontally-polarized radiation, and consequently the amount of vertically-polarized energy is greater than might appear at a cursory glance. The amount of power transferred from horizontal polarization to vertical polarization is about 12.5%, representing a reduction in the gain of the horizontally-polarized portion of about 0.5 db. This is a very small loss of power by comparison with an antenna producing circular polarization over the entire beam width, in which the loss is 3.0 db.

As so far described, the main beam of the horizontally-polarized array has been stated to be horizontally polarized. It will be recognized that there is a $-17$ dB 87.5° vertical component at a depression angle of $+0.75°$, which (from FIG. 12*a*) yields an ellipticity of about 17.5 dB with $\beta=2°$, which is essentially linear horizontal polarization.

While the described embodiment of the invention using parasitic radiators is highly advantageous, it should be recognized that the principles of the invention may be used with driven vertical and horizontal polarized antennas. The disadvantages of the use of driven antennas are the need for a power divider to divide the transmitter power into a portion for the vertically polarized antenna and a portion for the horizontally-polarized array, and the increased numbers of feed lines, the presence of conductive feed members for the vertically polarized components, which tend to perturb the radiation pattern.

Other embodiments of the invention will be apparent to those skilled in the art. In particular, the described antenna may be used in a lower-gain version for FM broadcast, in order to provide maximum horizontally-polarized coverage together with circular polarization to nearby listeners to improve stereo separation, which is degraded by multipath reception. Instead of a coaxial transmission line feed, a waveguide may be used in known fashion. The slots may be dumbbell-shaped, as known, rather than linear. Moreover, the principles of the invention may be applied to linear radiators other than slots. Naturally, the number of bays of radiators and the amplitude and phase of their illumination will depend upon the desired aperture size (gain), beam tilt, and amplitude of the "null fill" region at angles below the main beam.

What is claimed is:

1. A broadcast antenna, comprising:

elongated vertically oriented transmission-line means including a conductive outer surface, said outer surface defining a first plurality of bays each of which bays comprises slot antenna radiating means coupled to the interior of said transmision-line means, each of said slot antenna radiating means being vertically oriented for producing horizontally-polarized radiation, said plurality of bays being vertically arrayed between upper and lower locations and energized for producing horizontally-polarized radiation in a pattern having a preselected first peak gain near a horizontal plane and a lesser gain at angles below said horizontal plane; and a second plurality less than said first plurality of bays of parasitic radiating means, said second plurality of bays of parasitic radiating means being vertically arrayed at a location centered between said upper and lower locations, each of said parasitic radiating means being associated with one of said slot antenna radiating means for being energized thereby for reradiating substantially vertically-polarized radiation in phase quadrature with said horizontal radiation, said second plurality being selected to produce vertically-polarized radiation, substantially in phase quadrature with said horizontally polarized radiation in a pattern having a preselected second peak gain less than said first peak gain at said angles below said horizontal plane, whereby said antenna produces chiefly horizontal radiation towards distant locations and chiefly circular polarization towards locations near said antenna.

2. An antenna according to claim 1 wherein said transmission-line means comprises a coaxial transmission-line including an inner conductor associated with said conductive outer surface.

3. An antenna according to claim 1 further comprising a matched termination at the top end of said transmission-line means.

4. An antenna according to claim 1 further comprising a reactive termination at the top end of said transmission-line means.

5. An antenna according to claim 1 wherein said conductive outer surface is cylindrical, and each of said slot antenna radiating means comprises a plurality of elongated slots spaced about the periphery of said outer surface at the same longitudinal position.

6. An antenna according to claim 1 wherein said slot antenna radiating means includes an elongated slot formed in said conductive outer surface.

7. An antenna according to claim 6 wherein each of said parasitic radiating means comprises a vertically-oriented elongated straight conductor spaced less than $\lambda/4$ from said slot for reradiating a substantially vertically-polarized wave.

8. An antenna according to claim 6 wherein said first plurality of bays are spaced from each other by substantially one wavelength.

9. A television broadcast antenna, comprising:

elongated vertically-oriented transmission-line means;

a first plurality of bays of first radiating means vertically arrayed with a one-wavelength spacing between first and second locations on said transmission line means and energized thereby, each of said first radiating means being oriented for producing horizontally-polarized radiation, the energization of said bays being such that for each bay above a plane passing orthogonally through said axis at an imaginary center point between said first and second locations, which is excited with a particular signal amplitude and first phase, a corresponding bay below said plane is excited with said particular amplitude and with a second phase which is the negative of said first phase; and a second plurality less than said first plurality of bays of second radiating means oriented for producing vertically polarized radiation, each of said bays of second radiating means being colocated with one of said bays of first radiating means remote from said first and second locations, each of said bays of second radiating means being excited with an amplitude related to that signal amplitude with which the respective colocated one of said bays of first radiating means is energized.

10. An antenna according to claim 9 wherein said transmission-line means comprises a conductive outer surface;

said first radiating means comprises slot radiating means defined in said conductive outer surface; and said second radiating means comprises straight elongated parasitic radiating means, each of said parasitic radiating means being located adjacent one of said slot radiating means for being energized thereby.

11. An antenna according to claim 10 wherein each of said slot radiating means comprises a plurality of slots spaced about said transmission-line at a particular location between said first and second locations.

12. An antenna according to claim 10 wherein said first plurality is thirty-two, and said second plurality is four.

13. An antenna according to claim 10 wherein each of said slot radiating means comprises a slot having a predetermined width and further comprises a coupler comprising a cylindrical coupler having a diameter less than said width, said cylindrical coupler being conductively coupled to the interior of said conductive outer surface adjacent to and parallel with said slot.

14. An antenna according to claim 13, wherein at least some of said slot radiating means comprise a conductive mounting bar mounted between said interior of said conductive outer surface and said cylindrical coupler.

15. An antenna arrangement comprising:

a source of signal energy at a predetermined frequency;

straight elongated coaxial transmission-line means inlcuding an inner conductor and an outer conductor concentric about a first axis, said transmission-line means being vertically oriented and being coupled to said source of signal energy for coupling signal energy thereform;

a first plurality of bays of straight elongated slot radiating means formed in said outer conductor, said first plurality of bays being vertically arrayed between first and second locations along said transmission-line means, for coupling at least a portion of said signal energy from said coaxial transmission-line means and for generating a horizontally-polarized radiated field, each of said slot radiating means having a second axis, said second axis being parallel to said first axis of said straight elongated coaxial transmission-line means;

a second plurality less than said first plurality of bays of elongated straight conductive parasitic radiating means, each of said bays of said second plurality of parasitic radiating means being associated with one of said first plurality of bays located at positions remote from said first and second locations;

mechanical mounting means mechanically coupled to each of said parasitic radiating means and to said outer conductor for maintaining each of said parasitic radiating means in such a position relative to said slot radiating means of said associated bay that the projection of said third axis of each of said parasitic radiating means onto said outer conductor along a line radial to said first axis forms a predetermined acute angle on said outer conductor with said second axis of said slot radiating means of said associated bay, said predetermined acute angle being preselected so that a portion of the energy of said horizontally-polarized radiated field is coupled unto each of said parasitic radiating means and reradiated by said parasitic radiating means with substantially vertical polarization to form a reradiated vertically-polarized field, substantially quadrature with said horizontally-polarized field, said first plurality being selected to provide high gain in a generally horizontal direction and substantially lower gain at particular depression angles below said direction, said second plurality being selected to provide a gain at said particular depression angles which provides substantially equal-amplitude vertically-and horizontally-polarized field components at said particular depression angles whereby said antenna arrangement radiates horizontally-polarized radiation towards distant locations and circularly-polarized radiation towards locations defined by said particular depression angles.

* * * * *